United States Patent [19]

Harvey

[11] Patent Number: 4,875,888

[45] Date of Patent: Oct. 24, 1989

[54] EYE CONSTRUCTION FOR TOY DOLL

[76] Inventor: Thomas J. Harvey, 64 Floral Park Blvd., Pawtucket, R.I. 02861

[21] Appl. No.: 249,419

[22] Filed: Sep. 23, 1988

[51] Int. Cl.[4] ..... A63H 3/38

[52] U.S. Cl. ..... 446/392; 446/389

[58] Field of Search ..... 446/392, 389, 343–350; 623/4, 5, 6

[56] References Cited

U.S. PATENT DOCUMENTS

| | | | |
|---|---|---|---|
| 1,967,692 | 7/1934 | Walker | 446/392 |
| 2,295,890 | 9/1942 | Conrad | 446/392 |
| 4,393,619 | 7/1983 | Murch | 446/392 |
| 4,637,159 | 1/1987 | Kulis | 446/389 X |

FOREIGN PATENT DOCUMENTS

| | | | |
|---|---|---|---|
| 1475260 | 6/1977 | United Kingdom | 446/392 |

*Primary Examiner*—Mickey Yu

*Attorney, Agent, or Firm*—Salter & Michaelson

[57] ABSTRACT

An eye construction includes substantially circlar, concentric pupil and iris portions, a white portion which encircles said iris portion and a transparent cover portion on the white portion. The white portion includes a white portion surface which extends forwardly and diverges outwardly from the perimeter of the iris portion. The opposite side portions of the white portion surface diverge at greater angles than the opposite top and bottom portions of the white portion surface and, as a result, the eye is operative for creating an illusion that the pupil of the eye is following the movement of an observer when the eye is moved relative to the observer.

7 Claims, 1 Drawing Sheet

EYE CONSTRUCTION FOR TOY DOLL

BACKGROUND AND SUMMARY OF THE INVENTION

The instant invention relates to toys and more particularly to an eye construction for a toy doll.

Over the years, various types of eye constructions have been developed for use in connection with dolls and manikins, including eye constructions which are adapted to operate with various types of eye movement, as well as eye constructions consisting essentially of stationary components which are adapted to create illusions of various eye movements. In this regard, the eye constructions disclosed in MARCUS, U.S. Pat. No. 1,763,312; CONRAD, U.S. Pat. No. 2,295,890; WAGNER, U.S. Pat. No. 2,589,462; HEINA, U.S. Pat. No. 2,670,569; WAGNER, U.S. Pat. No. 2,791,869 and ANDERSON, U.S. Pat. No. 2,966,005 are generally exemplary of the heretofore available eye constructions and represent the closest prior art to the subject invention of which the applicant is aware. However, these references fail to teach or suggest the novel concepts and structural features of the eye construction of the instant invention, and hence they are believed to be of only general interest with respect thereto.

The instant invention provides an effective eye construction comprising stationary components which are adapted to create an illusion of eye movement when the eye is moved relative to an observer. Specifically, the eye construction of the instant invention is adapted to create an illusion that the pupil of the eye is moving to follow an observer when the eye is moved relative to the observer. The eye construction of the instant invention comprises substantially circular, concentric pupil and iris portions and a white portion which encircles the iris portion and includes a concave forwardly facing white portion surface. The concave white portion surface is formed so that it diverges outwardly from the perimeter of the iris portion, and the opposite side portions of the white portion surface are formed so that they diverge at greater angles than the top and bottom portions of the white portion surface. The eye construction further comprises a rounded dome-shaped, transparent cover portion on the white portion which is spaced forwardly from the iris portion and the pupil portion and covers the forwardly facing portions of the white portion, the iris portion and the pupil portion. The rounded domeshaped transparent cover portion preferably includes detent means for securing it to the white portion. The opposite outermost side portions of the white portion surface are preferably disposed so that they define an included angle of between 20° and 160°, and the opposite uppermost and lowermost portions of the white portion surface are preferably disposed so that they define an included angle of between 0° and 20°.

It has been found that the eye construction of the instant of the instant invention is operative for creating an illusion that the pupil of the eye is moving to follow or look at an observer during relative movement between the eye and the observer. Specifically, it has been found that the varying angles of divergence of the front surface of the white portion produce a unique effect which creates an illusion of eye movement during relative movement between the eye and the observer. The domeshaped, transparent cover portion enhances this effect by simulating a cornea of the eye.

Accordingly, it is a primary object of the instant invention to provide an effective eye construction which is operative for creating an illusion of eye movement during relative movement between the eye and an observer.

Another object of the instant invention is to provide an eye construction comprising a diverging white portion surface, wherein the opposite side portions of the white portion surface diverge at greater angles than the top and bottom portions of the white portion surface.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
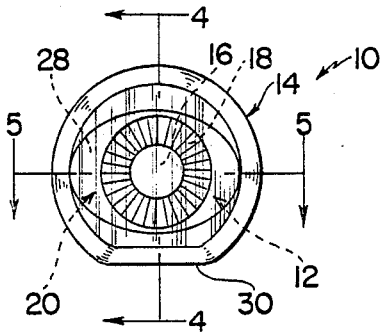
FIG. 1 is a front elevational view of the eye construction of the instant invention.
Figure 2:
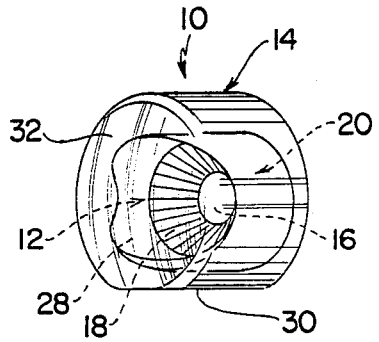
FIG. 2 is a perspective view thereof.
Figure 3:
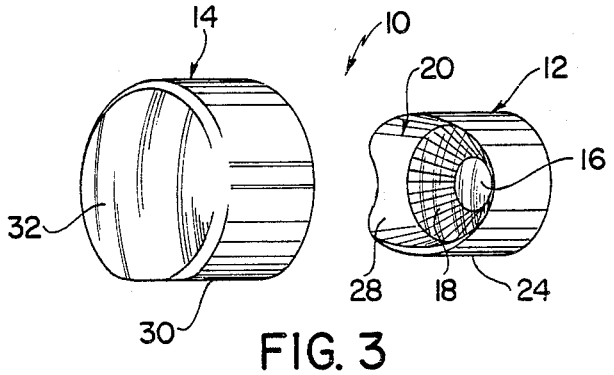
FIG. 3 is an exploded perspective view thereof.

Referring now to the drawing, the eye construction of the instant invention is illustrated in FIGS. 1–5 and generally indicated at 10. The eye 10 is adapted to provide an illusion of eye movement when the eye 10 is moved relative to an observer, and it includes an interior composite eye element generally indicated at 12 and a dome-shaped transparent cover portion generally indicated at 14 which covers the eye element 12.

The interior composite eye element 12 includes substantially, circular concentric pupil and iris portions 16 and 18, respectively, and a white portion generally indicated at 20. The pupil portion 16 is preferably made of a transparent, plastic material so that it appears to be essentially black when the eye 10 is mounted in the head of a doll; although, because of its transparency, it has a certain degree of depth in its overall appearance. The iris portion 18 is preferably integrally formed with the pupil portion 16 from a suitable transparent plastic material, and it includes a rear surface 22 which is preferably painted or otherwise colored to resemble the iris of a human eye. The rear surface 22 preferably has a plurality of radial striations thereon to further adapt the iris portion 18 to resemble the iris of a human eye. The front surfaces of the iris portion 18 and the pupil portion 16 are preferably formed so that they cooperate to define a smooth rounded surface as illustrated most clearly in FIGS. 4 and 5, and because the iris portion 18 is preferably integrally formed with the pupil portion 16 from a transparent plastic material, the iris portion 18 also has a certain degree of depth in its overall appearance.

Figure 4:
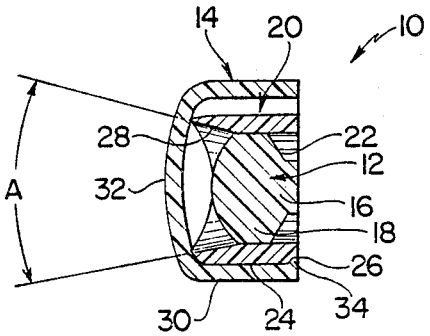
FIG. 4 is a sectional view taken along line 4—4 in FIG. 1.
Figure 5:
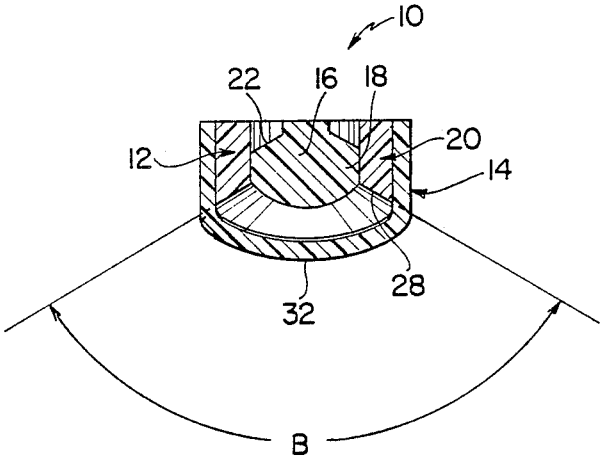
FIG. 5 is a sectional view taken along line 5—5 in FIG. 1.

The white portion 20 is preferably made from a suitable white plastic material, and it is secured to the iris portion 18 so that it encircles the latter. The white portion 20 has a generally oval-shaped outer configuration, although it includes a substantially flat bottom surface portion 24 having a downwardly facing notch 26 therein adjacent the rear extremity thereof. The white portion 20 includes a concave front surface 28 which diverges outwardly from the iris portion 18. In this regard, as illustrated in FIGS. 4 and 5, the front surface 28 is formed so that the opposite side portions thereof diverge at greater angles than the top and bottom portions thereof so that the white portion surface 28 actually has an oval-shaped concave configuration. More specifically, the white portion surface is formed so that the opposite outermost side portions thereof diverge at an included angle of between 20° and 160°, and so that the opposite uppermost and lowermost portions thereof diverge at an included angle of between 0° and 20°. As illustrated in FIG. 5, the opposite side portions of the white portion surface 28 preferably diverge at an included angle B which is approximately 120°; and as illustrated in FIG. 4, the opposite uppermost and lowermost portions of the white portion surface 28 preferably diverge at an included angle A which is approximately 10°.

The cover portion 14 is preferably integrally molded from a suitable transparent plastic material in a rounded substantially circular configuration; although it includes a flattened bottom portion 30. The cover portion 14 includes a rounded dome-shaped front portion 32 and it is receivable in engagement with the white portion 20 so that the front portion 32 is spaced forwardly from both the pupil portion 16 and the iris portion 18. In this connection, when the cover portion 14 is received in engagement on the white portion 20, the opposite side extremities of the white portion 20 engage the inner sides of the cover portion 14, and the bottom surface 24 engages the fattened bottom portion 30; whereas the upperportions of the white portion 20 are spaced downwardly slightly from the inner wall of the cover portion 14. The bottom portion 30 includes a detent 34 which is receivable in engagement in the notch 26 for retaining the cover portion 14 on the white portion 20.

It has been found that the eye construction of the instant invention effectively creates an illusion of eye movement when the eye 10 is moved relative to an observer. Specifically, it has been found that because of the varying angles of divergence of the white portion surface 28, the eye 10 creates an illusion that the pupil 16 is following the movement of an observer when the observer is moved from a position in front of the eye 10 to a position to the side of the eye 10. It has been further found that the constructions of the pupil portion 16 and the iris portion 18, as hereinabove set forth, enhance this illusion and that the dome-shaped cover portion 14 further enhances this illusion.

It is seen therefore that the instant invention provides an eye construction which can be effectively utilized in various toy dolls, manikins and the like. In this connection, because the eye 10 is operative for creating an illusion of eye movement without requiring moving components, it can be effectively utilized in various dolls and manikins, although it can nevertheless be manufactured relatively inexpensively. Hence, it is seen that the eye construction of the instant invention represents a significant advancement in the art which has a high level of commercial merit.

While there is shown and described herein certain specific structure embodying the invention, it will be manifest to those skilled in the art that various modifications and rearrangements of the parts may be made without departing from the spirit and scope of the underlying incentive concept and that the same is not limited to the particular forms herein shown and described except insofar as indicated by the scope of the appended claims.

What is claimed:

1. An eye construction comprising means simulating substantially circular concentric pupil and iris portions of an eye; a white portion encircling said iris portion, said white portion including a concave white portion surface which extends forwardly from the perimeter of said iris portion, opposite portions of said white portion surface diverging in their outward extents, the opposite side portions of said white portion surface diverging at greater angles than the opposite top and bottom portions of said white portion surface; and a rounded dome-shaped, transparent cover portion on said white portion covering the forwardly facing portions of said white portion, said iris portion and said pupil portion, said cover being spaced forwardly from said iris portion and said pupil portion, and an annular portion extending from the perimeter of said dome-shaped portion surrounding said white portion.

2. In the eye construction of claim 1, the opposite uppermost and lowermost portions of said white portion surface defining an included angle of less teen approximately 20°.

3. In the eye construction of claim 1, said iris portion and said pupil portion being integrally formed.

4. In the eye construction of claim 3, the forwardly facing portions of said iris portion and said pupil portion being defined by a rounded front surface.

5. The eye construction of claim 1 further comprising detent means for securing said cover portion to said while portion.

6. In the eye construction of claim 1, the opposite outermost side portions of said white portion surface defining an included angle of greater than approximately 20° and less than approximately 160°.

7. In the eye construction of claim 6, the uppermost and lowermost portions of said white portion surface defining an included angle of less than approximately 20°.

* * * * *